US011813847B2

(12) United States Patent
Kubodera

(10) Patent No.: US 11,813,847 B2
(45) Date of Patent: Nov. 14, 2023

(54) IMAGE FORMING APPARATUS WHICH HEATS RECORDING MEDIUM AT A HIGHER TEMPERATURE AT A DOWNSTREAM POSITION THAN AN UPSTREAM POSITION

(71) Applicant: Takaya Kubodera, Tokyo (JP)

(72) Inventor: Takaya Kubodera, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/696,960

(22) Filed: Mar. 17, 2022

(65) Prior Publication Data

US 2022/0324240 A1 Oct. 13, 2022

(30) Foreign Application Priority Data

Apr. 12, 2021 (JP) ..... 2021-067219

(51) Int. Cl.
*B41J 11/00* (2006.01)
*B41J 3/60* (2006.01)
*B41J 15/04* (2006.01)

(52) U.S. Cl.
CPC ..... *B41J 11/0022* (2021.01); *B41J 3/60* (2013.01); *B41J 15/042* (2013.01)

(58) Field of Classification Search
CPC ..... B41J 11/0022; B41J 3/60; B41J 15/042; B41J 11/00222; B41J 11/00242;
(Continued)

(56) References Cited

U.S. PATENT DOCUMENTS

2014/0125730 A1 5/2014 Lee et al.
2016/0313059 A1 10/2016 Boland et al.
(Continued)

FOREIGN PATENT DOCUMENTS

CN 105838142 A 8/2016
CN 111439026 A 7/2020
(Continued)

OTHER PUBLICATIONS

Extended European Search Report dated Jul. 19, 2022 in European Patent Application No. 22162099.0, 8 pages.
(Continued)

*Primary Examiner* — Bradley W Thies
(74) *Attorney, Agent, or Firm* — XSENSUS LLP

(57) ABSTRACT

An image forming apparatus includes a first liquid applier, a second liquid applier, a conveyor, and a heater. The first liquid applier applies liquid to a first side of a recording medium. The second liquid applier applies the liquid to a second side of the recording medium bearing the liquid applied to the first side by the first liquid applier. The conveyor conveys, in a conveyance direction, the recording medium bearing the liquid applied to the second side by the second liquid applier. The heater heats the recording medium conveyed by the conveyor. The conveyor conveys the recording medium in contact with the first side of the recording medium. The heater heats the recording medium at different temperatures between an upstream location and a downstream location in the conveyance direction of the recording medium.

9 Claims, 9 Drawing Sheets

(58) Field of Classification Search
CPC .... B41J 13/0045; B41J 2/01; B41J 11/00216; B41J 11/00244
See application file for complete search history.

(56) References Cited

U.S. PATENT DOCUMENTS

| | | | | |
|---|---|---|---|---|
| 2017/0153059 | A1 | 6/2017 | Boland et al. | |
| 2019/0232676 | A1 | 8/2019 | Kubodera et al. | |
| 2020/0023634 | A1* | 1/2020 | Dedic | B41F 23/0483 |

FOREIGN PATENT DOCUMENTS

| | | | |
|---|---|---|---|
| JP | 2002-219849 | | 8/2002 |
| JP | 2004-114303 | | 4/2004 |
| JP | 2007-302395 | | 11/2007 |
| JP | 2009-241309 | | 10/2009 |
| JP | 2017-124523 | A | 7/2017 |
| WO | 2018/143052 | A1 | 8/2018 |

OTHER PUBLICATIONS

Office Action dated Jun. 29, 2023 in Chinese Patent Application No. 202210373402.0, 7 pages.

* cited by examiner

IMAGE FORMING APPARATUS WHICH HEATS RECORDING MEDIUM AT A HIGHER TEMPERATURE AT A DOWNSTREAM POSITION THAN AN UPSTREAM POSITION

CROSS-REFERENCE TO RELATED APPLICATIONS

This patent application is based on and claims priority pursuant to 35 U.S.C. § 119(a) to Japanese Patent Application No. 2021-067219, filed on Apr. 12, 2021, in the Japan Patent Office, the entire disclosure of which is hereby incorporated by reference herein.

BACKGROUND

Technical Field

Embodiments of the present disclosure relate to an image forming apparatus.

Related Art

Inkjet image forming apparatuses typically apply ink to a recording medium and dry the ink applied to the recording medium by heating.

In a case where the inkjet image forming apparatuses form images on both sides of a recording medium, first, the image forming apparatuses apply liquid such as ink on a first side (e.g., front side) of the recording medium to form an image on the first side of the recording medium. Thereafter, the image forming apparatuses apply the liquid on a second side (e.g., back side) of the recording medium to form another image on the second side of the recording medium. Thereafter, the ink applied to the second side is heated and dried while the recording medium is conveyed with the first side in contact with, e.g., a conveyance roller.

SUMMARY

In one embodiment of the present disclosure, a novel image forming apparatus includes a first liquid applier, a second liquid applier, a conveyor, and a heater. The first liquid applier applies liquid to a first side of a recording medium. The second liquid applier applies the liquid to a second side of the recording medium bearing the liquid applied to the first side by the first liquid applier. The conveyor conveys, in a conveyance direction, the recording medium bearing the liquid applied to the second side by the second liquid applier. The heater heats the recording medium conveyed by the conveyor. The conveyor conveys the recording medium in contact with the first side of the recording medium. The heater heats the recording medium at different temperatures between an upstream location and a downstream location in the conveyance direction of the recording medium.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
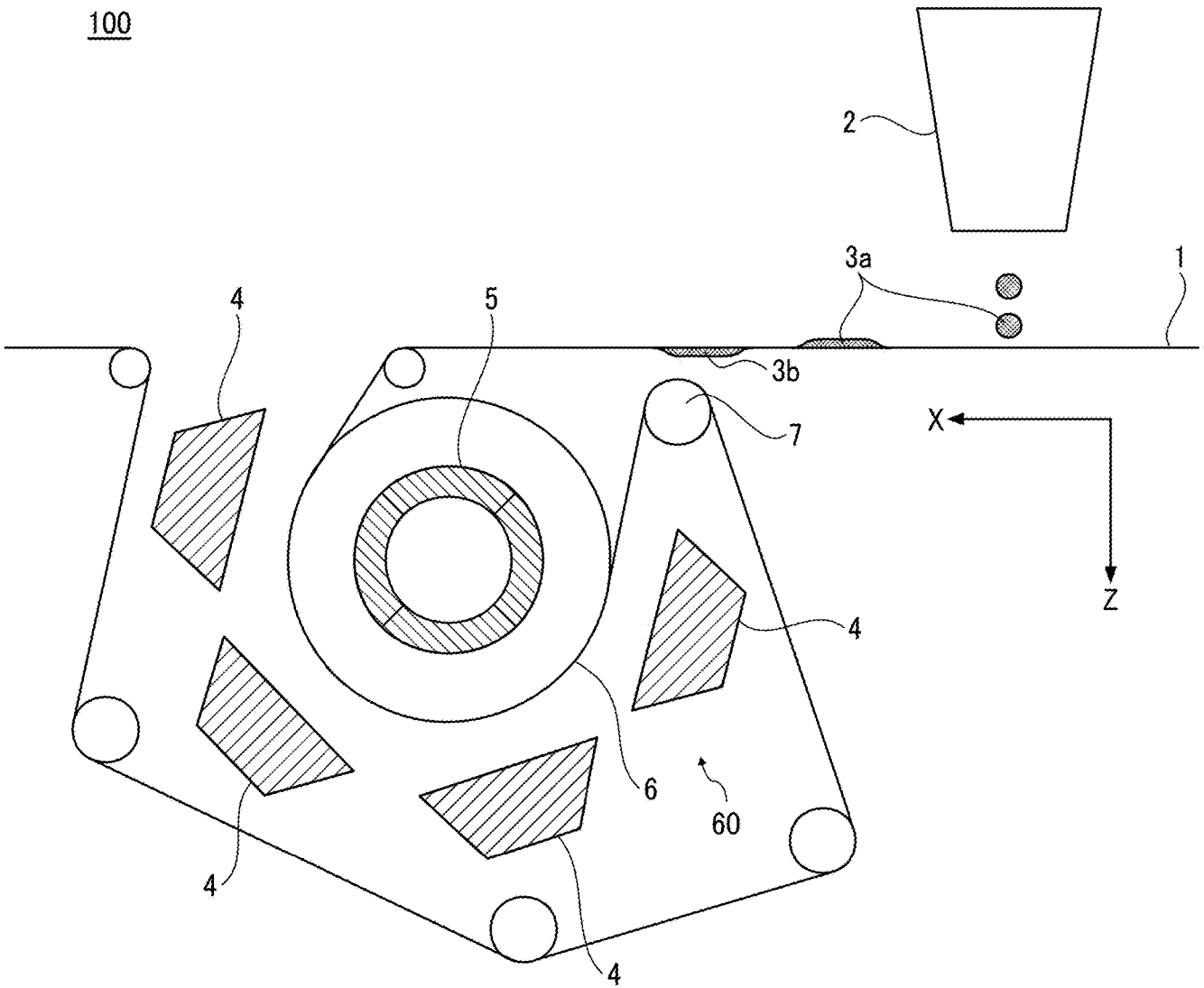
FIG. 1 is a diagram illustrating an overall configuration of an image forming apparatus according to a first embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

For the sake of simplicity, like reference numerals are given to identical or corresponding constituent elements such as parts and materials having the same functions, and redundant descriptions thereof are omitted unless otherwise required.

Now, a description is given of a first embodiment of the present disclosure.

Initially with reference to FIG. 1, a description is given of an overall configuration of an image forming apparatus according to the first embodiment.

FIG. 1 is a diagram illustrating an overall configuration of an image forming apparatus 100.

In the following description, an "X direction" refers to a direction in which a sheet 1 serving as a recording medium is conveyed. A "Z direction" refers to a gravity direction, which is a direction perpendicular to the X direction. A "Y direction" refers to a direction perpendicular to the X direction.

In addition, in the following description, a "front side" serves as a first side of two sides of a recording medium (e.g., the sheet 1). By contrast, a "back side" serves as a second side opposite the first side of the two sides of the recording medium.

For example, as illustrated in FIG. 1, the image forming apparatus 100 discharges droplets of, e.g., ink to form an image on the sheet 1.

Now, a description is given of an example in which a head 2 serves as an image forming device.

The image forming apparatus 100 discharges ink from the head 2 to form images on both sides of the sheet 1, for example. Specifically, first, the image forming apparatus 100 discharges ink, which may be referred to as a "front-side ink 3*b*" in the following description, to form an image on the first side of the sheet 1. After turning over the sheet 1, for example, the image forming apparatus 100 discharges ink, which may be referred to as a "back-side ink 3*a*" in the following description, to form another image on the second side of the sheet 1 as illustrated in FIG. 1.

As described above, the sheet 1 serves as a recording medium according to the present embodiment. The front side of the sheet 1 serves as a first side according to the present embodiment. The back side of the sheet 1 serves as a second side according to the present embodiment. The ink serves as a liquid according to the present embodiment.

The sheet 1 is conveyed by, e.g., a conveyance roller 7. In other words, as the conveyance roller 7 rotates, the sheet 1 moves in a direction of rotation of the conveyance roller 7. Specifically, the conveyance roller 7 rotated by an actuator such as a motor conveys the sheet 1. In the present example, the conveyance roller 7 conveys the sheet 1 to a drying roller 6 after an image is formed with the head 2, for example.

The drying roller 6 dries the sheet 1. The drying roller 6 is a component of a drying unit 60, which has the following configuration, for example.

Figure 2:
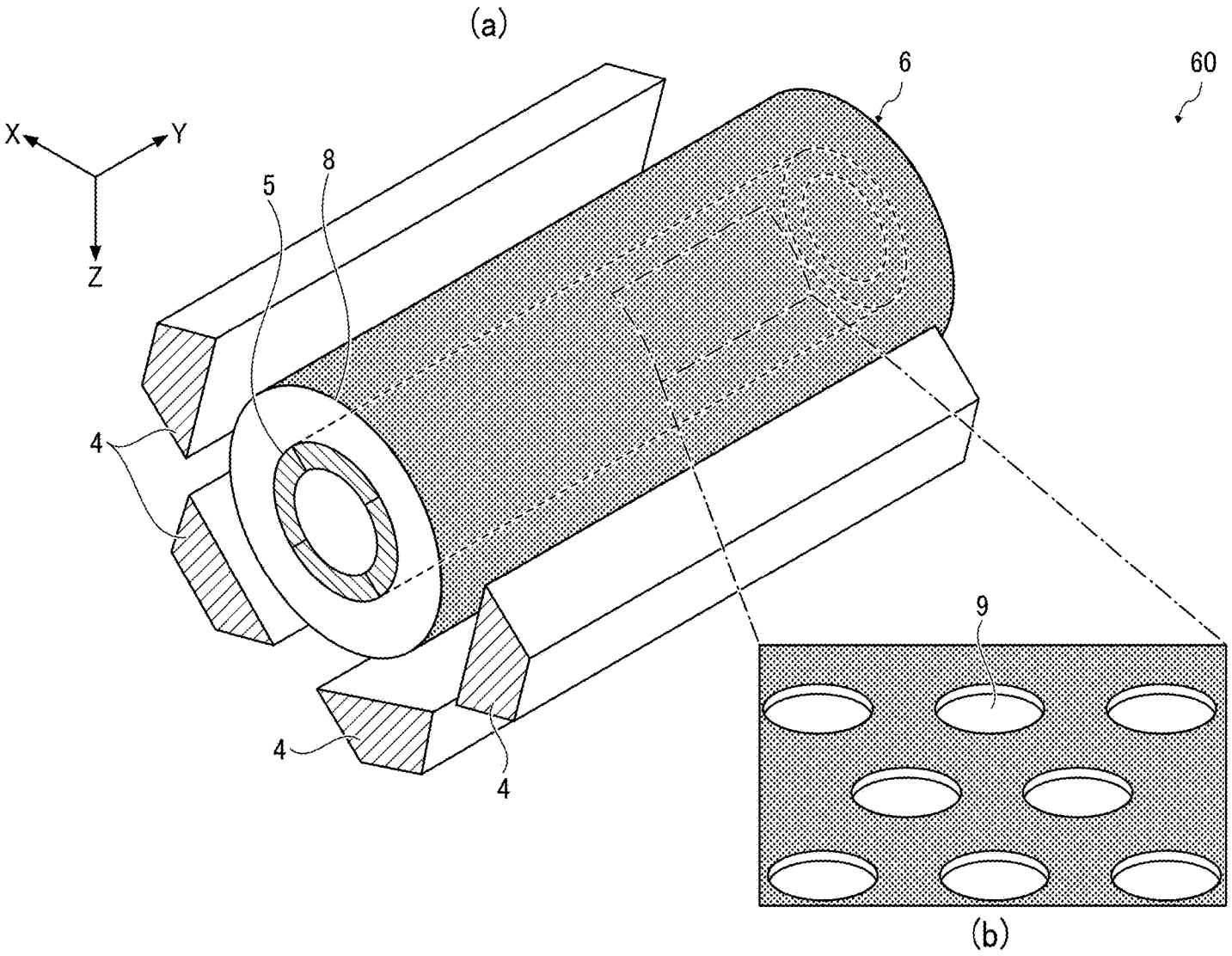
FIG. 2 is a diagram illustrating a configuration of a drying unit.

Referring now to FIG. 2, a description is given of an example of the configuration of the drying unit 60.

FIG. 2 is a diagram illustrating an example of the configuration of the drying unit 60.

For example, as illustrated in part (a) of FIG. 2, the drying roller 6 includes a roller 8 that conveys the sheet 1 and a heater 5 disposed inside the roller 8 for heating.

The roller 8 is preferably made of a material having an increased thermal conductivity such as metal. Like the conveyance roller 7, the roller 8 is a device or a mechanism that conveys the sheet 1. Specifically, as illustrated in FIG. 1, the roller 8 contacts the sheet 1 to convey and heat the sheet 1. In other words, the roller 8 conveys and heats the sheet 1 in contact with the sheet 1. The surface of the roller 8 serves as a heating surface that conducts the heat from the heater 5 to the sheet 1. For this reason, the roller 8 is preferably made of a material that easily conducts heat from the heater 5.

The heater 5 is disposed inside the drying roller 6 concentrically with respect to an axis of the roller 8 as illustrated in FIG. 2, for example.

As illustrated in FIG. 2, the drying unit 60 preferably includes at least one dryer 4 in addition to the drying roller 6. Since the drying unit 60 of the present example dries the sheet 1 with the drying roller 6 and the dryer 4 that sends warm air, the drying unit 60 applies higher heat to the sheet 1 than a drying unit without the dryer 4. In short, the drying unit 60 of the present example dries the sheet 1 at a higher speed than the drying unit without the dryer 4.

The drying unit 60 may include the single dryer 4 or a plurality of dryers 4 as illustrated in FIG. 2.

The dryer 4 is, e.g., a warm-air heater or an infrared (IR) heater. In other words, the dryer 4 is preferably a non-contact dryer that dries the sheet 1 without contacting the sheet 1. This is because a non-contact dryer less likely to be contaminated or to contaminate the sheet 1 than a contact dryer that contacts and dries the sheet 1.

Part (b) of FIG. 2 is a partially enlarged view of the heating surface.

The heating surface has, e.g., a through-hole 9 serving as a recess according to the present embodiment. The through-hole 9 reduces an area of contact between the heating surface and the sheet 1. In other words, the through-hole 9 reduces the possibility of contamination of the heating surface.

The through-hole 9 is formed by punching the heat surface, for example.

When the heating surface is contaminated, a contaminant adhering to the heating surface may be transferred to a recording medium on which an image is to be formed thereafter. In short, when the heating surface is contaminated, the contaminant on the heating surface may contaminate the recording medium. In other words, a reduced contamination of the heating surface also reduces the contamination of the recording medium.

The recess may have a shape other than the shape illustrated in FIG. 2. In other words, the recess is not limited to a through-hole, provided that the recess has a structure that reduces an area of contact between the heating surface and a recording medium. Alternatively, for example, the recess may be a non-through hole that does not pass through the heating surface. The recess is not limited to a round recess. In short, the recess may have a given shape such as a rectangular shape, an elliptical shape, or a star shape, or a combination of such shapes.

The heating surface may have a convex portion. For example, the convex portion is formed by raising a part of the heating surface or by disposing metal on the heating surface. The convex portion may have any structure that reduces the area of contact between the heating surface and the sheet 1.

Now, a description is given of a second embodiment of the present disclosure.

Figure 3:
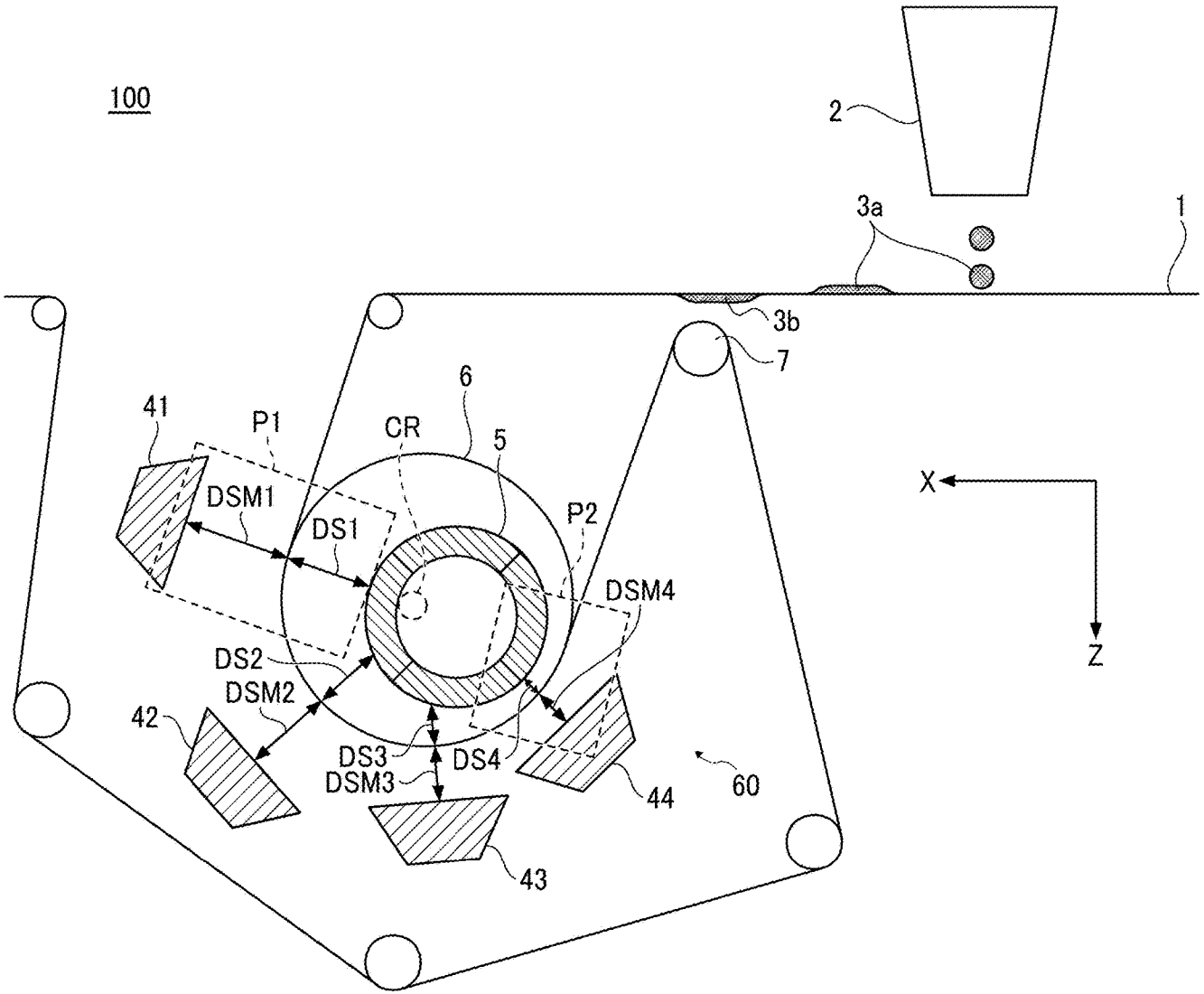
FIG. 3 is a diagram illustrating an overall configuration of an image forming apparatus according to a second embodiment of the present disclosure.

FIG. 3 is a diagram illustrating an overall configuration of an image forming apparatus according to the second embodiment of the present disclosure.

In the following description, components like those of the first embodiment are denoted by like reference numerals, and redundant descriptions thereof are omitted.

The second embodiment is different from the first embodiment in that the heater 5 and the dryer 4 are controlled such that the temperature distribution varies depending on the location.

For example, the heater 5 and the drier 4 are controlled such that the following temperature distributions are obtained at a location at which the sheet 1 contacts the drying roller 6 first and a location at which the sheet 1 contacts the drying roller 6 last, of the locations at which the sheet 1 contacts the drying roller 6. In the following description, the location at which the sheet 1 contacts the drying roller 6 first and the location at which the sheet 1 contacts the drying roller 6 last may be referred to as a "first part P1" and a "second part P2," respectively.

Note that the first part P1 may be any location upstream from the second part P2 in a recording-medium conveyance direction in which a recording medium (e.g., the sheet 1) is conveyed. In other words, while the first part P1 is an upstream location in the recording-medium conveyance direction, the second part P2 may be any location downstream from the first part P1 in the recording-medium conveyance direction.

In the following description, the dryers 4 illustrated in FIG. 1 are referred to as a "first dryer 41," a "second dryer 42," a "third dryer 43," and a "fourth dryer 44" in this order in the recording-medium conveyance direction along a passage through which the sheet 1 is conveyed. The first dryer 41 is a dryer that is used at the first part P1. The fourth dryer 44 is a dryer that is used at the second part P2.

The heater 5 is constructed of a plurality of sub-heaters. In other words, the heater 5 is controlled so as to obtain different temperatures between the parts of the drying unit 60.

Figure 4:
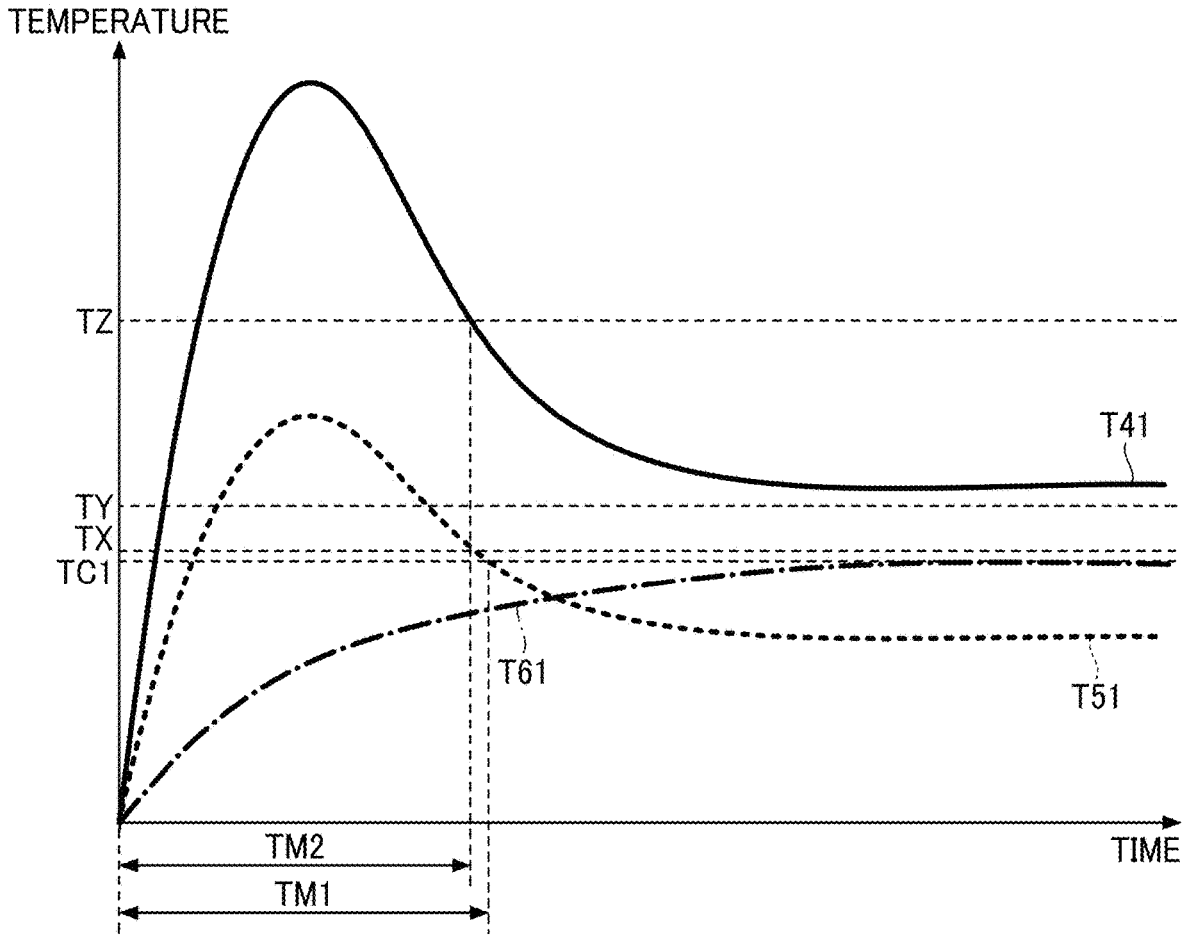
FIG. 4 is a diagram illustrating an example of temperature control at a first part.

Referring now to FIG. 4, a description is given of an example of temperature control at the first part P1.

FIG. 4 is a diagram illustrating an example of temperature control at the first part P1.

For example, the heater 5 is controlled to heat the heating surface used at the first part P1 at a first heating temperature T51. On the other hand, the first dryer 41 is controlled to dry the sheet 1 at the first part P1 at a first back-side temperature T41. The first back-side temperature T41 is a temperature of the warm air that hits the back side of the sheet 1.

The first heating temperature T51 increases due to heating by the heater 5. As the first heating temperature T51 increases, the temperature of the heating surface that is used for heating at the first part P1 of the surface of the drying roller 6 increases. Note that the temperature of the heating surface that is used for heating at the first part P1 may be referred to as a "first-part heating surface temperature T61" in the following description. The first-part heating surface temperature T61 is a temperature at which the front side of the sheet 1 is heated. In the present example of temperature control, the first-part heating surface temperature T61 is set to converge to a first convergence temperature TC1.

Figure 5:
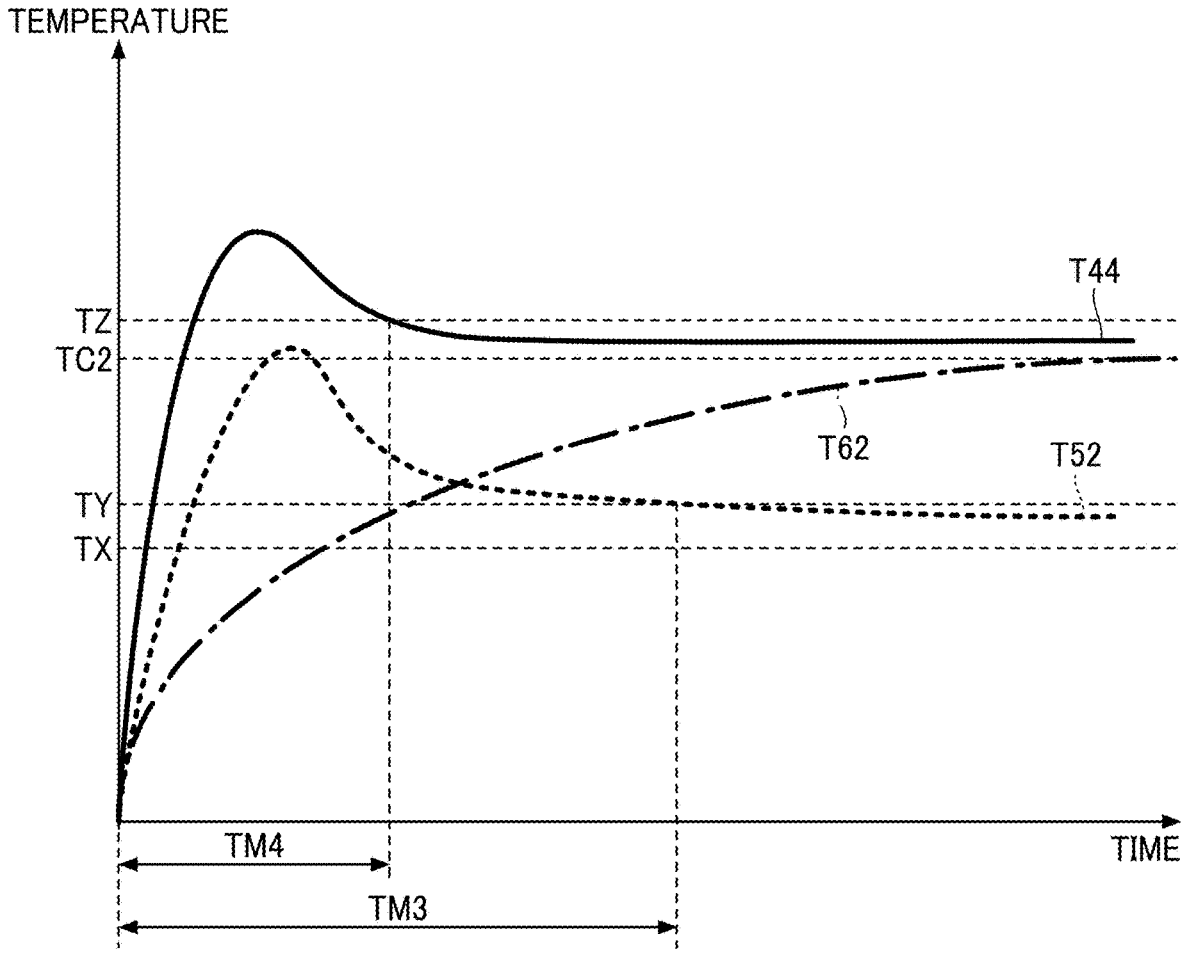
FIG. 5 is a diagram illustrating an example of temperature control at a second part.

Referring now to FIG. 5, a description is given of an example of temperature control at the second part P2.

For example, while the temperature control is performed as described above at the first part P1, the temperature control is performed as described below at the second part P2.

FIG. 5 is a diagram illustrating an example of temperature control at the second part P2.

Like the temperature control at the first part P1, for example, the heater 5 is controlled to heat the heating surface used at the second part P2 at a second heating temperature T52. On the other hand, the fourth dryer 44 is controlled to dry the sheet 1 at the second part P2 at a second back-side temperature T44. The second back-side temperature T44 is a temperature of the warm air that hits the back side of the sheet 1.

The second heating temperature T52 increases due to heating by the heater 5. As the second heating temperature T52 increases, the temperature of the heating surface that is used for heating at the second part P2 of the surface of the drying roller 6 increases. Note that the temperature of the heating surface that is used for heating at the second part P2 may be referred to as a "second-part heating surface temperature T62" in the following description. The second-part heating surface temperature T62 is a temperature at which the front side of the sheet 1 is heated. In the present example of temperature control, the second-part heating surface temperature T62 is set to converge to a second convergence temperature TC2.

As described above, the second convergence temperature TC2 is preferably set to be higher than the first convergence temperature TC1. In other words, the temperature is preferably controlled such that the sheet 1 is dried at a higher temperature at the second part P2 as a downstream location than at the first part P1 as an upstream location in the recording-medium conveyance direction.

In many cases, the ink on the sheet 1 is drier at a downstream location than at an upstream location in the recording-medium conveyance direction. Therefore, the sheet 1 is preferably dried at a lower temperature at an upstream location such as the first part P1 than at a downstream location in the recording-medium conveyance direction. For example, an image on the sheet 1 may be insufficiently dried at an upstream location in the recording-medium conveyance direction. In other words, the image may be so-called half-drying at the upstream location. When the heat surface at a relatively high temperature contacts such an insufficiently dried image, the ink is likely to adhere to the heating surface. In other words, the heating surface is likely to be contaminated.

A decreased temperature reduces such contamination of the heating surface. Therefore, the sheet 1 is preferably dried at a relatively low temperature such as the first convergence temperature TC1 at an upstream location in the recording-medium conveyance direction.

On the other hand, the image on the sheet 1 is drier at a downstream location such as the second part P2 than at an upstream location in the recording-medium conveyance direction, because the sheet 1 is dried to some extent at the upstream location. In other words, the sheet 1 is preferably dried at a higher temperature at a downstream location than at an upstream location in the recording-medium conveyance direction. The image may be sufficiently dried when the image is dried at a higher temperature at a downstream location than at an upstream location in the recording-medium conveyance direction.

In order to dry the sheet 1 at different temperatures between an upstream location and a downstream location in the recording-medium conveyance direction, different heaters may be used at the upstream and downstream locations, for example. In a case where a single heater is used to control upstream and downstream temperatures to be different from each other in the recording-medium conveyance direction, for example, different metals may be used for upstream and downstream portions of the heating surface, or the upstream and downstream portions of the heating surface may be thermally insulated to some extent. The arrangement of the heating surface and the components is not limited to the arrangement illustrated in FIG. 3 provided that the upstream and downstream temperatures are different from each other.

For example, the following configuration is preferable to achieve upstream and downstream temperatures different from each other in the recording-medium conveyance direction.

As illustrated in FIG. 3, the heater 5 is preferably disposed eccentrically with respect to a center CR of the drying roller 6. The center CR of the drying roller 6 may be referred to simply as the "center CR" in the following description. For example, as illustrated in FIG. 3, the heater 5 is preferably disposed eccentrically with respect to the center CR so as to be closer to the surface of the drying roller 6 at a downstream location than at an upstream location in the recording-medium conveyance direction.

As the heater 5 is disposed eccentrically, the distance from the heater 5 to the surface of the drying roller 6 may be set differently depending on the location along the passage through which the sheet 1 is conveyed. In the following description, the distance from the heater 5 to the surface of the drying roller 6 may be referred to simply as "distance."

Specifically, the distance at the first part P1 is referred to as a "first distance DS1." Preferably, the heater 5 is disposed eccentrically having the distances of a second distance DS2, a third distance DS3, and a fourth distance DS4 in this order downstream from the first part P1 in the recording-medium conveyance direction.

In other words, preferably, the heater 5 is disposed such that the distance between the heating surface and the heater 5 decreases downstream in the recording-medium conveyance direction, satisfying the relation of "the first distance DS1>the second distance DS2>the third distance DS3>the fourth distance DS4."

As the distance increases, less heat is conveyed from the heat source. Thus, the temperature tends to decrease as the distance increases. For this reason, preferably, the eccentric arrangement of the heater 5 is adjusted to decrease the distance downstream in the recording-medium conveyance direction to dry the sheet 1 at temperatures increasing downstream in the recording-medium conveyance direction.

A "dryer distance," which refers to the distance between the dryer 4 and the recording medium (e.g., the sheet 1) at a location, is preferably set differently depending on the location. For example, the dryer distance between the first dryer 41 and the recording medium at the first part P1 is referred to as a "first dryer distance DSM1." Preferably, the dryers 4 are disposed having the dryer distances of a second dryer distance DSM2, a third dryer distance DSM3, and a fourth dryer distance DSM4 in this order downstream from the first part P1 in the recording-medium conveyance direction.

As the dryer distance increases, less warm air reaches the sheet 1 from the dryer 4. Thus, the temperature tends to decrease as the dryer distance increases. For this reason, preferably, the dryer distance is adjusted to decrease downstream in the recording-medium conveyance direction to dry the sheet 1 at temperatures increasing downstream in the recording-medium conveyance direction.

The way of drying the sheet 1 at different temperatures between an upstream location and a downstream location in the recording-medium conveyance direction is not limited to the aforementioned way of setting different distances and different dryer distances at the upstream and downstream locations. Alternatively, for example, the heating by the heater 5 may be increased or decreased to achieve upstream and downstream temperatures different from each other in the recording-medium conveyance direction.

Preferably, the following temperatures are set.

As illustrated in FIGS. 4 and 5, a first preset temperature TX, a second preset temperature TY, and a third preset temperature TZ are preferably set.

The first preset temperature TX is preferably the highest temperature of temperatures at which half-drying ink is not transferred to the drying roller 6 even in contact with the drying roller 6, for example.

The second preset temperature TY is preferably a temperature sufficient to dry the ink. In other words, the second preset temperature TY is, e.g., a temperature at which the ink is sufficiently solidified, for which allowance may be set.

The third preset temperature TZ is preferably a temperature that is approximately the melting point of an additive such as wax added to the ink. In other words, at a temperature equal to or lower than the third preset temperature TZ, the dried ink is not melted even in contact with the drying roller 6, and thus the ink is less likely to be transferred to the sheet 1. By contrast, at a temperature higher than the third preset temperature TZ, the tacking force of the ink is likely to increase. In other words, the ink is likely to adhere to and be transferred to the sheet 1.

For example, as illustrated in FIG. 4, the temperature of the heating surface at the first part P1 is preferably controlled to be equal to or lower than the first preset temperature TX to converge to the first convergence temperature TC1.

The temperature of the heating surface thus controlled so as to be equal to or lower than the first preset temperature TX reduces the possibility of transfer of the half-drying ink from the recording medium onto the heating surface even when the recording medium bearing the half-drying ink is in contact with the heating surface, thus reducing the contamination of the heating surface.

Similarly, the first heating temperature T51 is preferably controlled so as to converge to a temperature equal to or lower than the first preset temperature TX.

However, when the drying roller 6 is not yet sufficiently heated (for example, during a first pre-heating period TM1 in FIG. 4), the first heating temperature T51 may be a high temperature exceeding, e.g., the first preset temperature TX. In other words, the first-part heating surface temperature T61, which is a temperature of the drying roller 6, does not rise in many cases like the first heating temperature T51 even when the first heating temperature T51 rises rapidly as in the first pre-heating period TM1. Therefore, the first heating temperature T51 may be a high temperature exceeding the first preset temperature TX as in the first pre-heating period TM1 until the first-part heating surface temperature T61 is increased to a certain temperature.

Note that the first pre-heating period TM1 is set in advance according to the material of the drying roller 6, the time until the temperature converges, and the temperature characteristics, for example. The first pre-heating period TM1 may be longer than the period illustrated in FIG. 4, for example.

The first heating temperature T51 is preferably a temperature not exceeding the third preset temperature TZ even in the first pre-heating period TM1.

The first heating temperature T51 is preferably controlled so as to converge to a temperature equal to or lower than the first preset temperature TX when the first-part heating surface temperature T61 has converged.

Similarly, when the drying roller 6 is not yet sufficiently heated, the first back-side temperature T41 may be a high temperature exceeding, e.g., the third preset temperature TZ as in a second pre-heating period TM2. On the other hand, the first back-side temperature T41 is preferably controlled so as to converge to a temperature exceeding the second preset temperature TY when the first-part heating surface temperature T61 has converged.

Note that the first preset temperature TX, the second preset temperature TY, and the third preset temperature TZ often vary depending on, e.g., the type of droplet and the amount of droplet. Therefore, an appropriate temperature for each preset temperature is determined in advance by experiments, for example.

At the second part P2, the temperature is preferably controlled as illustrated in FIG. 5 according to the first preset temperature TX, the second preset temperature TY, and the third preset temperature TZ, which have been described above in the example of temperature control at the first part P1.

Specifically, first, the second heating temperature T52 is preferably controlled so as to be equal to or higher than the first preset temperature TX and not higher the third preset temperature TZ when the second-part heating surface temperature T62 has converged. Like the temperature control at the first part P1, the second heating temperature T52 may be a high temperature exceeding the second preset temperature TY as in a third pre-heating period TM3 when the drying roller 6 is not yet sufficiently heated.

The second-part heating surface temperature T62 is preferably set to converge to a temperature equal to or lower than the third preset temperature TZ. In addition, the second-part heating surface temperature T62 may be set to converge to a temperature exceeding the second preset temperature TY. However, the second-part heating surface temperature T62 may be set to converge to a temperature exceeding the second preset temperature TY preferably when the ink is expected to be dried to some extent at the second part P2.

The second back-side temperature T44 is preferably controlled so as to be a temperature equal to or higher than the second preset temperature TY when the second-part heating surface temperature T62 has converged. When the drying roller 6 is not yet sufficiently heated, the second back-side temperature T44 may be a high temperature exceeding the third preset temperature TZ as in a fourth pre-heating period TM4.

The temperature control described above prevents contamination of the heating surface and reduces contamination of the recording medium.

When the drying roller 6 is made of a material having a relatively small heat capacity, the drying roller 6 may be heated easily. Therefore, it may be difficult to obtain a difference in temperature between the first part P1 and the second part P2 as described above. In order to obtain a difference in temperature between the first part P1 and the second part P2, a cooler or cooling assembly may be disposed between the first part P1 and the second part P2 to cool the drying roller 6. With such a cooler or cooling assembly, a temperature gradient is obtained between the first part P1 and the second part P2. In other words, the drying roller 6 has a temperature distribution.

Now, a description is given of a third embodiment of the present disclosure.

The third embodiment is different from, e.g., the second embodiment in that the amount of heat for drying the ink and the drying capability of the dryer 4 are calculated and compared as follows. In the following description, components like those of the first and second embodiments are denoted by like reference numerals, and redundant descriptions thereof are omitted.

In the following description, a "maximum heat amount" may refer to an amount of heat at the drying capacity at the highest temperature of temperatures settable to the heater 5. The maximum heat amount may be denoted by "Qo" and indicated by joule (J) in the system of measurement. The maximum heat amount "Qo" is calculated in advance for each printing speed.

In the following description, a "drying heat amount" may refer to an amount of heat used to dry ink to prevent the ink from being transferred to another object. The drying heat amount may be denoted by "Qi" and indicated by joule (J) in the system of measurement.

Now, a description is given of an example in which the maximum heat amount "Qo" serves as a first heat amount and the drying heat amount "Qi" serves as a second heat amount.

The maximum heat amount "Qo" is calculated by Equation (1) below, for example.

$$Qo = Ch \times \rho \times Vi \times \Delta t \quad (1)$$

In Equation (1) above, "Ch" denotes specific heat of ink. In the following description, the specific heat of ink may be referred to simply as "specific heat" and indicated by joule per kilogram per degree Celsius (J/kg·° C.) in the system of measurement. "ρ" denotes the density of ink. In the following description, the density of ink may be referred to simply as "density" and indicated by kilogram per liter (kg/L) in the system of measurement. "Vi" denotes a total amount of ink calculated from, e.g., data of an image to be formed. In the following description, the total amount of ink may be referred to simply as "ink amount" and indicated by liter (L) in the system of measurement. "Δt" denotes a width of a temperature increase caused by drying the recording medium passing through a drying part such as the first part P1. In the following description, the width of the temperature increase may be referred to simply as an increase width and indicated by degree Celsius (° C.) in the system of measurement. "t" denotes a period of time taken for the recording medium to pass through a drying part such as the first part P1. In the following description, the period to time may be referred to simply as a "passing time" and indicated by second in the system of measurement. Note that the recording medium is in contact with the heating surface at the drying part. The passing time "t" coincides with a period of time during which the recording medium is in contact with the heating surface at the drying part. Like denotations are used in the following description.

The increase width "Δt" is obtained by the difference between the temperature of the last ink at the drying part and the temperature of the first ink at the drying part. The passing time "t" is calculated by "X÷V÷60=t" where V denotes the printing speed indicated by meter per minute (mpm) and X denotes the length of the drying part indicated by meter (m).

Based on Equation (1) above, the maximum heat amount per unit time "ΔQo" indicated by watt (W) in the system of measurement is calculated by Equation (2) below, for example.

$$\Delta Qo = Ch \times \rho \times Vi \times \Delta t / t \quad (2)$$

In order to specify the ink amount "Vi," for example, the color gradation is set to "10% to 100%," and the ink amount is stored in advance in stages for each gradation. Accordingly, the ink amount is specified, e.g., in units of pixels, based on the color gradation indicated by image data.

For example, in a case where the printing speed "V" is any one of "V1, "V2," and "V3," the ink amount "Vi" and a variable element "Δt/t" at the maximum heat amount per unit time have the following relationship.

Figure 6:
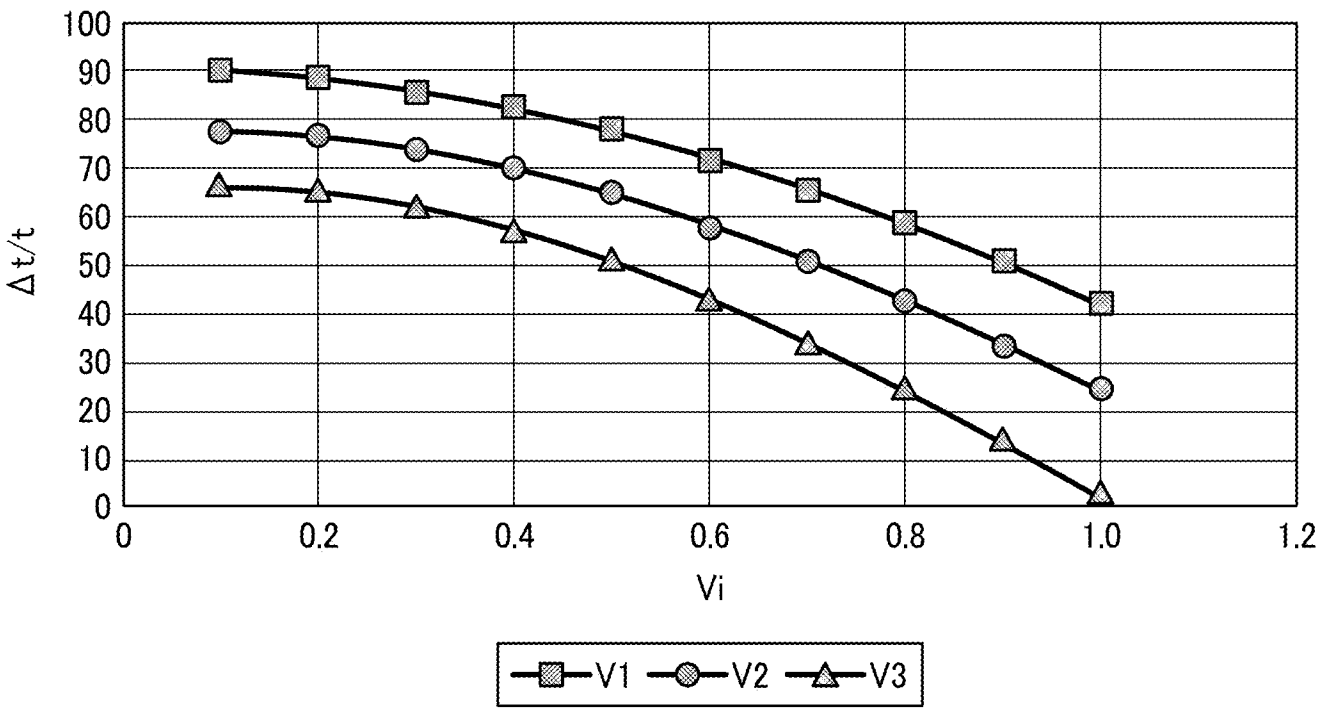
FIG. 6 is a diagram illustrating a relationship between an ink amount and a variable element at a maximum heat amount per unit time.

FIG. 6 is a diagram illustrating a relationship between the ink amount "Vi" and the variable element "Δt/t" at the maximum heat amount per unit time.

In FIG. 6, the horizontal axis represents the ink amount "Vi." On the other hand, the vertical axis represents the variable element "Δt/t" at the maximum heat amount per unit time. FIG. 6 illustrates an example in which the printing speed "V" has three speeds: "V1," "V2," and "V3." The printing speed "V" increases in the order of "V1," "V2," and "V3." In other words, a relation of V1<V2<V3 is satisfied.

As the printing speed "V" increases, the period of time during which the recording medium is in contact with the heating surface decreases at the drying part. Therefore, as the printing speed "V" increases, the increase width "Δt" tends to decrease.

Droplets of, e.g., ink are dried when, e.g., moisture or an organic solvent contained in the droplets is evaporated. In order to dry the ink to prevent the ink from being transferred to another object, at least an amount of heat for increasing the temperature to a temperature at which, e.g., the moisture or organic solvent contained in the droplets is evaporated and an amount of heat for vaporizing the ink are applied to the ink.

In other words, the drying heat amount per unit time "ΔQi" indicated by watt (W) in the system of measurement is calculated by Equation (3) below, for example.

$$\Delta Qi=\rho\times Vi\times\{Ck+\Delta t'\times Ch\}/t \quad (3)$$

In Equation (3) above, "Ck" denotes an amount of heat for vaporizing ink per unit material. In the following description, the amount of heat for vaporizing ink may be referred to simply as "heat of vaporization" and indicated by kilojoules per kilogram (kJ/kg) in the system of measurement. Respective denotations of "ρ," "Vi," "Ch," and "t" are the same as those in Equation (1) above.

"Δt'" denotes a temperature difference between an initial temperature of ink and a temperature at which, e.g., the moisture or organic solvent contained in the ink is evaporated. In the following description, the temperature difference between the initial temperature of the ink and the temperature at which, e.g., the moisture or organic solvent contained in the ink is evaporated may be referred to simply as "temperature difference" and indicated by degree Celsius (° C.) in the system of measurement.

Note that the drying heat amount per unit time "ΔQi" calculated by Equation (3) above may be converted into that for water by Equation (4) below, for example.

Water often has higher values of heat of vaporization and specific heat than other types of solvents. Therefore, even in a case where a plurality of other types of solvents is contained, calculation of the heat amount for water facilitates calculation of the amount of heat for sufficiently drying the entire ink.

$$\Delta Qi=\rho\times Vi\times(x/xw)\times\{Ckw+\Delta t'\times Chw\}/t \quad (4)$$

In Equation (4) above, "x" denotes the mass of ink indicated by gram (g) in the system of measurement. "xw" denotes an amount of water contained in the ink indicated by gram (g) in the system of measurement. "Ckw" denotes the heat of vaporization of water indicated by kilojoules per kilogram (kJ/kg). "Chw" denotes the specific heat of water indicated by joule per kilogram per degree Celsius (J/kg·° C.).

Based on the calculated maximum heat amount "Qo" and drying heat amount "Qi," comparison and determination are performed preferably as below.

Figure 7:
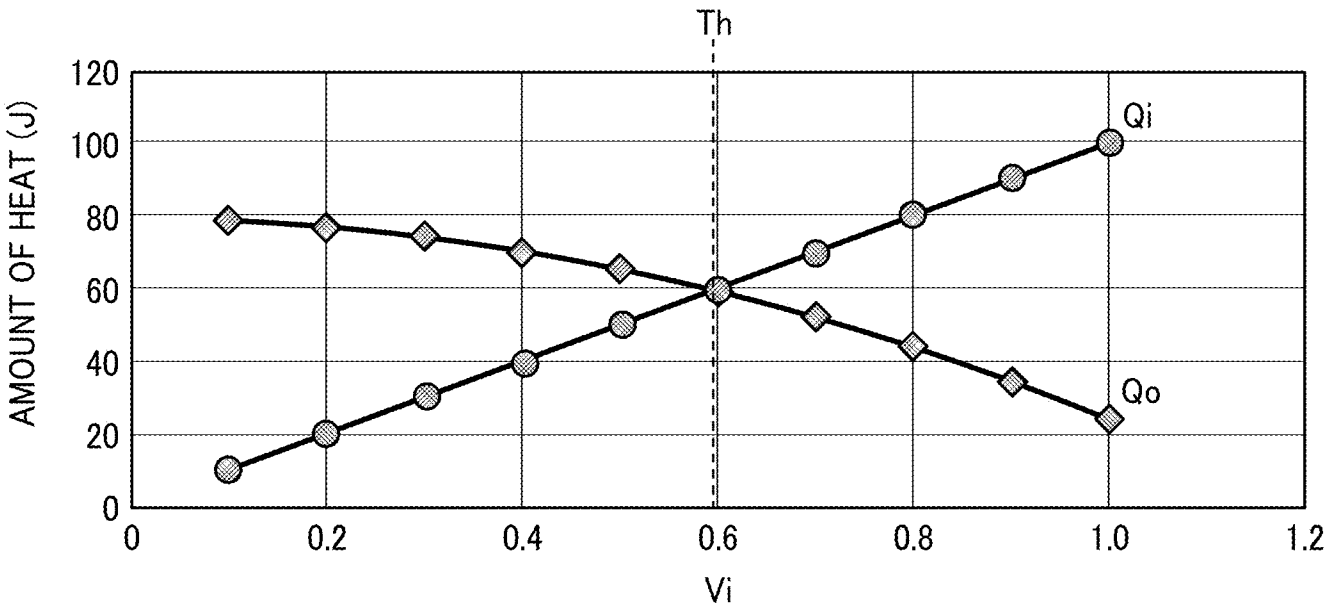
FIG. 7 is a diagram illustrating a relationship between a maximum heat amount and a drying heat amount.

FIG. 7 is a diagram illustrating a relationship between the maximum heat amount and the drying heat amount.

In FIG. 7, the horizontal axis represents the ink amount "Vi." On the other hand, the vertical axis represents the amount of heat.

The maximum heat amount "Qo" is, e.g., a value calculated by Equation (1) above.

The drying heat amount "Qi" is, e.g., a value obtained by multiplying the value calculated by Equation (3) above by the passing time "t."

Based on an intersecting point at which the maximum heat amount "Qo" and the drying heat amount "Qi" intersect, the image forming apparatus determines whether to dry the recording medium at different temperatures between an upstream location and a downstream location in the recording-medium conveyance direction. In the following description, "Vi" at the intersecting point may be referred to as a "threshold Th." In other words, at the threshold Th, the maximum heat amount "Qo" is equal to the drying heat amount "Qi."

When the maximum heat amount "Qo" is equal to or smaller than the drying heat amount "Qi" (i.e., Qo≤Qi) as illustrated to the right of the threshold Th in FIG. 7, the image forming apparatus determines to dry the recording medium at different temperatures between an upstream location and a downstream location in the recording-medium conveyance direction. By contrast, when the maximum heat amount "Qo" is greater than the drying heat amount "Qi" (i.e., Qo>Qi) as illustrated to the left of the threshold Th in FIG. 7, the image forming apparatus determines not to dry the recording medium at different temperatures between an upstream location and a downstream location in the recording-medium conveyance direction.

When drying the recording medium at different temperatures between an upstream location and a downstream location in the recording-medium conveyance direction, the image forming apparatus controls the temperature such that the downstream temperature is higher than the upstream temperature.

When the maximum heat amount "Qo" is greater than the drying heat amount "Qi" (i.e., Qo>Qi), in other words, when the ink amount is relatively small, the ink is sufficiently dried by the heating surface without setting upstream and downstream temperatures to be different from each other in the recording-medium conveyance direction in many cases. Therefore, preferably, the image forming apparatus compares the maximum heat amount "Qo" serving as the first heat amount with the drying heat amount "Qi" serving as the second heat amount and controls the temperature to dry the recording medium at different temperatures between an upstream location and a downstream location in the recording-medium conveyance direction when the second heat amount is equal to or greater than the first heat amount.

As described above, when the image forming apparatus compares the first heat amount and the second heat amount calculated based on, e.g., the ink amount and sufficiently dries the ink on the recording medium with the heating surface in view of the drying capability, the image forming apparatus dries the recording medium with the heating surface, without drying the recording medium at different temperatures between an upstream location and a downstream location in the recording-medium conveyance direction. Accordingly, the image forming apparatus shortens the start-up time taken to achieve upstream and downstream temperatures different from each other in the recording-medium conveyance direction.

By contrast, when the second heat amount is smaller than the first heat amount, the ink on the recording medium may be dried insufficiently at a single part. In such a case, the image forming apparatus control the temperature to dry the recording medium at different temperatures between an upstream location and a downstream location in the recording-medium conveyance direction.

For example, the image forming apparatus controls the temperature to dry the recording medium at temperatures increasing downstream in the recording-medium conveyance direction. The temperature control described above prevents contamination of the heating surface and reduces contamination of the recording medium.

Now, a description is given of an overall process.

Figure 8:
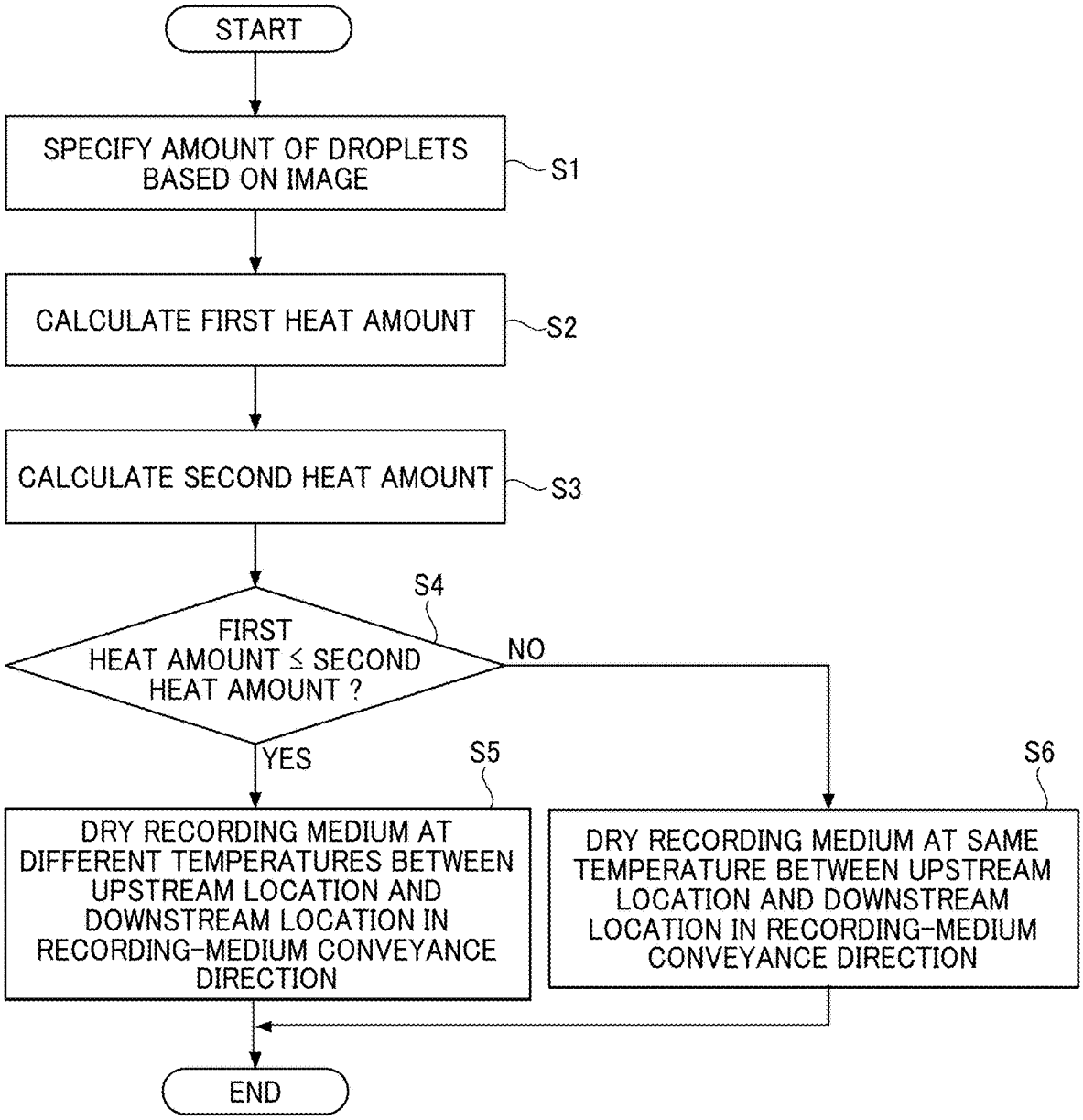
FIG. 8 is a flowchart of an overall process.

FIG. 8 is a flowchart of an example of the overall process.

In step S1, the image forming apparatus specifies an amount of droplets based on an image. Specifically, the image forming apparatus inputs data indicating an image to be formed and specifies, based on the data, an amount of ink that is used for the image.

In step S2, the image forming apparatus calculates the first heat amount.

In step S3, the image forming apparatus calculates the second heat amount.

In step S4, the image forming apparatus determines whether the first heat amount is equal to or greater than the second heat amount. As a result of comparing the first heat amount with the second heat amount, when the first heat amount is equal to or greater than the second heat amount (YES in step S4), the image forming apparatus proceeds to step S5. By contrast, when the first heat amount is not equal to or greater than the second heat amount (NO in step S4), the image forming apparatus proceeds to step S6.

In step S5, the image forming apparatus dries a recording medium at different temperatures between an upstream location and a downstream location in the recording-medium conveyance direction.

In step S6, the image forming apparatus dries a recording medium at the same temperature between an upstream location and a downstream location in the recording-medium conveyance direction.

As described above, the image forming apparatus compares the first heat amount with the second heat amount to determine whether to dry the recording medium at different temperatures between an upstream location and a downstream location in the recording-medium conveyance direction.

Now, a description is given of a third embodiment of the present disclosure.

Figure 9:
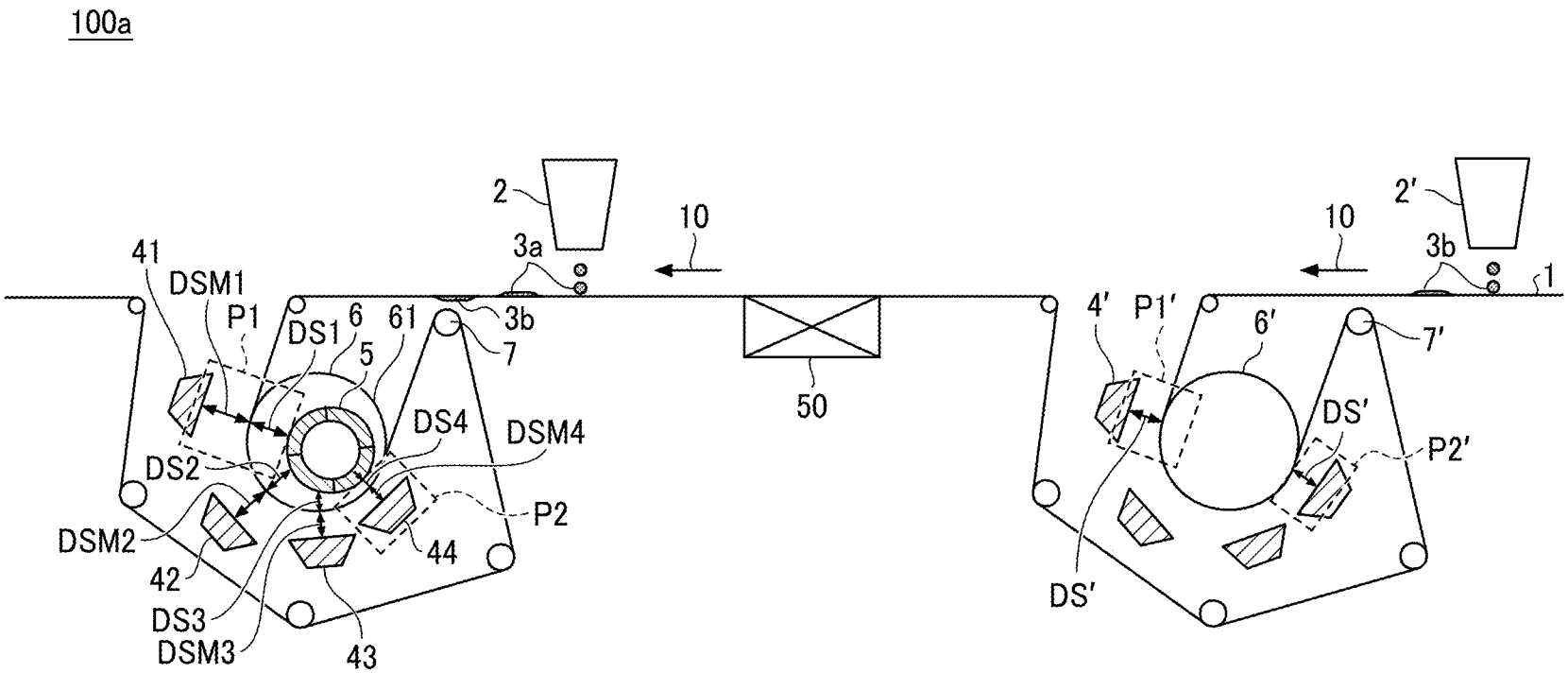
FIG. 9 is a diagram illustrating an overall configuration of an image forming apparatus according to a third embodiment of the present disclosure.

Referring now to FIG. 9, a description is given of a configuration of an image forming apparatus according to the third embodiment.

In the following description, components like those of the first and second embodiments are denoted by like reference numerals, and redundant descriptions thereof are omitted.

FIG. 9 is a diagram illustrating an overall configuration of an image forming apparatus 100*a* according to the third embodiment.

As illustrated in FIG. 9, the image forming apparatus 100*a* includes a front-side head 2', a drier 4', a conveyance drum 6', a conveyance roller 7', and a turntable 50.

The front-side head 2' serves as a first liquid applier that applies ink to the front side of the sheet 1, according to the present embodiment.

The front-side head 2' discharges ink to cause the discharged ink to land on the front side of the sheet 1. Thus, the front-side head 2' applies ink to the front side of the sheet 1. The front-side ink 3*b* illustrated in FIG. 9 represents the ink applied to the front side of the sheet 1.

The conveyance drum 6' rotates with an outer circumferential surface of the conveyance drum 6' in contact with the back side of the sheet 1, thus conveying the sheet 1 in a conveyance direction 10 as a recording-medium conveyance direction. The conveyance roller 7' is disposed downstream from the conveyance drum 6' in the conveyance direction 10. The conveyance roller 7' rotates with an outer circumferential surface of the conveyance roller 7' in contact with the back side of the sheet 1, thus conveying the sheet 1 in the conveyance direction 10.

Like the dryers 4, the dryer 4' includes four warm-air heaters. The four warm-air heaters are disposed at different locations along the conveyance direction 10 so as to face the sheet 1 conveyed by the conveyance drum 6'. A distance DS' represents the distance between the dryer 4' and the outer circumferential surface of the conveyance drum 6'.

The dryer 4' supplies warm air from the four warm-air heaters to the sheet 1 conveyed, thus heating the sheet 1 to dry the ink applied to the front side of the sheet 1. The dried ink is fixed onto the front side of the sheet 1. A part P1' refers to an upstream part of the conveyance drum 6' in the recording-medium conveyance direction. A part P2' refers to a downstream part of the conveyance drum 6' in the recording-medium conveyance direction.

The dryer 4' collectively refers to the four warm-air heaters. However, the number of warm-air heaters included in the dryer 4' is not limited to four and may be increased or decreased. The dryer 4' is not limited to a dryer including warm-air heaters. Alternatively, the dryer 4' may include another type of heaters such as IR heaters or may include a combination of multiple types of heaters.

The turntable 50 serves as a changer that changes the orientation of the sheet 1 to cause the back side of the sheet 1 bearing the ink applied to the front side by the front-side head 2' to face the head 2. The turntable 50 is disposed downstream from the conveyance roller 7' in the conveyance direction 10. The turntable 50 changes the orientation of the sheet 1 so as to turn over the sheet 1. As a result, the back side of the sheet 1 faces the head 2 at a location at which the head 2 is disposed.

After the front-side head 2' applies the ink to the front side of the sheet 1 and the drier 4' heats and dries the ink on the sheet 1, the sheet 1 is turned over by the turntable 50 and conveyed to the location of the head 2 so that the back side of the sheet 1 faces the head 2.

The head 2 serves as a second liquid applier that applies ink to the back side of the sheet 1 conveyed, according to the present embodiment. The head 2 discharges ink to cause the discharged ink to land on the back side of the sheet 1. Thus, the head 2 applies ink to the back side of the sheet 1. The back-side ink 3*a* illustrated in FIG. 9 represents the ink applied to the back side of the sheet 1.

The drying roller 6 serves as a conveyor that conveys, in the conveyance direction 10, the sheet 1 bearing the ink applied to the back side by the head 2, according to the present embodiment. The drying roller 6 contacts the front side of the sheet 1 to convey the sheet 1. In other words, the drying roller 6 conveys the sheet 1 in contact with the front side of the sheet 1. Specifically, the drying roller 6 conveys the sheet 1 with an outer circumferential surface 61 of the drying roller 6 in contact with the front side of the sheet 1, which is a side bearing the front-side ink 3*b*.

The drying roller 6 incorporates the heater 5. The heater 5 serves as a heater that heats the sheet 1 conveyed by the drying roller 6, according to the present embodiment. The heater 5 heats the sheet 1 that is in contact with the outer circumferential surface 61 of the drying roller 6, to dry the ink applied to the back side of the sheet 1. The first part P1 refers to an upstream part of the drying roller 6 in the recording-medium conveyance direction. The second part P2 refers to a downstream part of the drying roller 6 in the recording-medium conveyance direction.

Each of the first dryer 41, the second dryer 42, the third dryer 43, and the fourth dryer 44 serves as a heater that heats the sheet 1 conveyed by the drying roller 6, according to the present embodiment. The first dryer 41, the second dryer 42, the third dryer 43, and the fourth dryer 44 each including a warm-air heater are disposed at different locations along the conveyance direction 10 so as to face the sheet 1 conveyed by the conveyance drum 6'. The first dryer 41, the second dryer 42, the third dryer 43, and the fourth dryer 44 supply warm air from the four warm-air heaters to the sheet 1 conveyed, thus heating the sheet 1 to dry the ink applied to the back side of the sheet 1. The dried ink is fixed onto the back side of the sheet 1.

Note that the number of the first dryer 41, the second dryer 42, the third dryer 43, and the fourth dryer 44 is not limited to four and may be increased or decreased. Each of the first dryer 41, the second dryer 42, the third dryer 43, and the fourth dryer 44 is not limited to a dryer including a warm-air heater. Alternatively, the first dryer 41, the second dryer 42, the third dryer 43, and the fourth dryer 44 may include another type of heaters such as IR heaters or may include a combination of multiple types of heaters.

In the present embodiment, the first dryer 41, the second dryer 42, the third dryer 43, the fourth dryer 44, and the heater 5 serve as heaters. However, the heaters are not limited to the first dryer 41, the second dryer 42, the third dryer 43, the fourth dryer 44, and the heater 5. The heater may be the heater 5 or the dryers such as the first dryer 41, the second dryer 42, the third dryer 43, and the fourth dryer 44.

In a case where the sheet 1 is heated by the heater 5 or the dryers, namely, the first dryer 41, the second dryer 42, the third dryer 43, and the fourth dryer 44, the front-side ink 3*b* applied to the front side of the sheet 1 may be remelted when heated. If the remelted front-side ink 3*b* adheres to the outer circumferential surface 61 of the drying roller 6, the front-side ink 3*b* adhering to the outer circumferential surface 61 of the drying roller 6 may be transferred to the front side, which is in contact with the outer circumferential surface 61 of the drying roller 6, of the subsequent sheets 1 that are conveyed thereafter. As a result, the subsequent sheets 1 may be contaminated.

In particular, since an upstream portion, in the conveyance direction 10, of the sheet 1 that is in contact with the outer circumferential surface 61 of the drying roller 6 is conveyed shorter than a downstream portion, in the conveyance direction 10, of the sheet 1 after the sheet 1 is heated and dried by the drier 4', the fixability of the front-side ink 3*b* to the sheet 1 is lower on the upstream portion of the sheet 1 than on the downstream portion of the sheet 1. In other words, the front-side ink 3*b* is more likely to be remelted on the upstream portion of the sheet 1 and cause contamination than on the downstream portion of the sheet 1. Note that the fixability of the front-side ink 3*b* to the sheet 1 refers to the fixing strength and stability of the front-side ink 3*b* with respect to the sheet 1.

To address such an unfavorable situation, in the present embodiment, the first dryer 41, the second dryer 42, the third dryer 43, the fourth dryer 44, and the heater 5 heat the sheet 1 at different temperatures between an upstream location and a downstream location in the conveyance direction 10 of the sheet 1.

For example, the first dryer distance DSM1 between the outer circumferential surface 61 of the drying roller 6 and the first dryer 41 that is disposed at an upstream location in the conveyance direction 10 is longer than the second dryer distance DSM2 between the outer circumferential surface 61 of the drying roller 6 and the second dryer 42 that is disposed at a location downstream from the first dryer 41 in the conveyance direction 10. As the first dryer distance DSM1 is longer than the second dryer distance DSM2, the first dryer 41 heats the sheet 1 at a lower heating temperature than the second dryer 42.

Similarly, the second dryer distance DSM2 between the outer circumferential surface 61 of the drying roller 6 and the second dryer 42 is longer than the third dryer distance DSM3 between the outer circumferential surface 61 of the drying roller 6 and the third dryer 43 that is disposed at a location downstream from the second dryer 42 in the conveyance direction 10. As the second dryer distance DSM2 is longer than the third dryer distance DSM3, the second dryer 42 heats the sheet 1 at a lower heating temperature than the third dryer 43.

Similarly, the third dryer distance DSM3 between the outer circumferential surface 61 of the drying roller 6 and the third dryer 43 is longer than the fourth dryer distance DSM4 between the outer circumferential surface 61 of the drying roller 6 and the fourth dryer 44 disposed at a location downstream from the third dryer 43 in the conveyance direction 10. As the third dryer distance DSM3 is longer than the fourth dryer distance DSM4, the third dryer 43 heats the sheet 1 at a lower heating temperature than the fourth dryer 44.

On the other hand, the first distance DS1 between the heater 5 and the outer circumferential surface 61 of the drying roller 6 facing the first dryer 41 is longer than the second distance DS2 between the heater 5 and the outer circumferential surface 61 of the drying roller 6 facing the second dryer 42. As the first distance DS1 is longer than the second distance DS2, the heater 5 heats the sheet 1 at a lower heating temperature when the sheet 1 faces the first dryer 41 than when the sheet 1 faces the second dryer 42.

Similarly, the second distance DS2 between the heater 5 and the outer circumferential surface 61 of the drying roller 6 facing the second dryer 42 is longer than the third distance DS3 between the heater 5 and the outer circumferential surface 61 of the drying roller 6 facing the third dryer 43. As the second distance DS2 is longer than the third distance DS3, the heater 5 heats the sheet 1 at a lower heating temperature when the sheet 1 faces the second dryer 42 than when the sheet 1 faces the third dryer 43.

Similarly, the third distance DS3 between the heater 5 and the outer circumferential surface 61 of the drying roller 6 facing the third dryer 43 is longer than the fourth distance DS4 between the heater 5 and the outer circumferential surface 61 of the drying roller 6 facing the fourth dryer 44. As the third distance DS3 is longer than the fourth distance DS4, the heater 5 heats the sheet 1 at a lower heating temperature when the sheet 1 faces the third dryer 43 than when the sheet 1 faces the fourth dryer 44.

With such a configuration, the sheet 1 in contact with the outer circumferential surface 61 of the drying roller 6 is heated such that the upstream portion of the sheet 1, which is conveyed shorter than the downstream portion of the sheet 1 after the sheet 1 is heated and dried by the drier 4', is heated at a lower heating temperature than the downstream portion of the sheet 1. Accordingly, the present embodiment reduces the risk for the front-side ink 3*b* being remelted and prevents contamination of the sheet 1.

On the other hand, in order to reduce the risk for the front-side ink 3*b* of being remelted, for example, the heating temperatures of the first dryer 41, the second dryer 42, the third dryer 43, the fourth dryer 44, and the heater 5 may be decreased as a whole to such an extent that the front-side ink 3*b* is not remelted. However, since this way decreases the heating temperatures as a whole, the conveyance speed of the sheet 1 may be reduced to increase the heating time or the sheet 1 may be conveyed at an increased distance after heated and dried by the drier 4' to sufficiently dry the front-side ink 3*b* and the back-side ink 3*a*. As a result, the productivity, which is the efficiency with which the image forming apparatus 100*a* performs image formation, may decrease while the image forming apparatus 100*a* may increase in size.

To address such an unfavorable situation, in the present embodiment, the first dryer 41, the second dryer 42, the third dryer 43, the fourth dryer 44, and the heater 5 heat the sheet 1 at a higher heating temperature at a downstream location than at an upstream location in the conveyance direction 10 of the sheet 1.

Such a configuration sufficiently dries the front-side ink 3*b* and the back-side ink 3*a* without reducing the conveyance speed of the sheet 1 to increase the heating time or increasing the conveyance distance of the sheet 1 after the sheet 1 is heated and dried by the dryer 4'. Accordingly, the present embodiment enhances the productivity of the image forming apparatus 100*a* while preventing contamination of the sheet 1. In addition, the present embodiment prevents an increase in size of the image forming apparatus 100*a* while preventing contamination of the sheet 1.

Further, in the present embodiment, the image forming apparatus 100*a* includes the turntable 50 serving as a changer that changes the orientation of the sheet 1 to cause the back side of the sheet 1 bearing the front-side ink 3*b* applied to the front side by the front-side head 2' to face the head 2. The front-side head 2' faces the front side of the sheet 1 and applies the front-side ink 3*b*. The head 2 faces the back side of the sheet 1 and applies the back-side ink 3*a*. The turntable 50 is disposed between the front-side head 2' and the head 2.

Such a configuration reduces labor and time taken to reload the sheet 1 onto the image forming apparatus 100*a* to form an image on each of the front side and the back side of the sheet 1. Accordingly, the present embodiment enhances the productivity of the image forming apparatus 100*a*. In addition, the present embodiment prevents contamination of the sheet 1 while enhancing the productivity of the image forming apparatus 100*a*.

The type of the recording medium is not limited to a sheet of paper. In other words, the recording medium may be made of a material other than paper. Specifically, the recording medium may be made of any material including, e.g., paper, yarn, fiber, fabric, leather, metal, plastic, glass, wood, or ceramics, provided that liquid can adhere to the material at least temporarily. Therefore, examples of types of the recording medium may include, but are not limited to, a film product, a cloth product such as clothing, a building material such as wallpaper or a floor material, and a material used for a leather product.

The recording medium is not limited to a cut sheet. Alternatively, for example, the recording medium may be a rolled sheet.

Now, a description is given of other embodiments of the present disclosure.

For example, a nozzle head and a head driving device may construct a single device.

Each of the above-described devices may not be a single device. For example, each of the above-described devices may be a combination of multiple devices. The image forming apparatus 100 and the image forming apparatus 100*a* may further include a device other than the devices illustrated in the accompanying drawings.

Note that all or part of the processes according to the embodiments of the present disclosure may be described in a computer language and implemented by programs that cause a computer to execute a control method. In other words, the programs are computer programs for causing a computer such as a droplet discharging apparatus, an image forming apparatus, a droplet discharging system, or an image forming system to execute the processes.

Therefore, when the control method is executed according to the programs, an arithmetic device and a control device included in the computer perform arithmetic and control, respectively, according to the programs to execute the respective processes. A storage device included in the computer stores data that is used for the processes according to the programs so that the computer executes the processes.

The programs may be recorded in a computer-readable recording or carrier medium and distributed. Note that examples of the recording or carrier medium include, but are not limited to, a magnetic tape, a flash memory, an optical disk, a magneto-optical disc, and a magnetic disk. The programs may be distributed through a telecommunication line.

The embodiments of the present disclosure may be implemented by a droplet discharging system or an image forming system including a plurality of information processing devices. The droplet discharging system or the image forming system may execute the processes and data storage in a redundant, distributed, parallel, or virtualized manner, or in a combination of such manners.

According to the embodiments of the present disclosure, contamination of recording media is prevented.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. An image forming apparatus comprising:

a first liquid applier to apply liquid to a first side of a recording medium;

a second liquid applier to apply the liquid to a second side of the recording medium bearing the liquid applied to the first side by the first liquid applier;

a conveyor to convey, in a conveyance direction, the recording medium bearing the liquid applied to the second side by the second liquid applier; and a heater to heat the recording medium which has the liquid on the first side and the second side, and which has been conveyed by the conveyor, the conveyor to convey the recording medium in contact with the first side of the recording medium, the heater to heat the recording medium which has the liquid on the first side and the second side at different temperatures between an upstream location and a downstream location in the conveyance direction of the recording medium, wherein a temperature of the heater at a most upstream side is lower than a temperature of the heater at a most downstream side in the conveyance direction of the recording medium.

2. The image forming apparatus according to claim 1, further comprising a changer configured to change an orientation of the recording medium to cause the second side of the recording medium bearing the liquid applied to the first side by the first liquid applier to face the second liquid applier, wherein the first liquid applier is configured to face the first side of the recording medium and apply the liquid, wherein the second liquid applier is configured to face the second side of the recording medium and apply the liquid, and wherein the changer is disposed between the first liquid applier and the second liquid applier.

3. The image forming apparatus according to claim 1, wherein:

there is no liquid applier between the most upstream side of the heater and the most downstream side of the heater.

4. The image forming apparatus according to claim 1, further comprising:

a drying roller, wherein:

the heater is internal to the drying roller; and the heater is disposed eccentrically with respect to a center of the drying roller.

5. The image forming apparatus according to claim 4, wherein:

the heater is closer to a surface of the drying roller at a downstream location than at an upstream location in the conveyance direction of the recording medium.

6. The image forming apparatus according to claim 1, further comprising:

a drying roller having the heater therein; and a plurality of dryers surrounding the drying roller, wherein a most upstream dryer in the conveyance direction of the recording medium performs less drying than the most downstream dryer in the conveyance direction of the recording medium.

7. The image forming apparatus according to claim 6, wherein:

the most upstream dryer in the conveyance direction of the recording medium is further from the drying roller than the most downstream dryer in the conveyance direction of the recording medium.

8. The image forming apparatus according to claim 7, wherein:

the heater is disposed eccentrically with respect to a center of the drying roller.

9. The image forming apparatus according to claim 8, wherein:

the heater is closer to a surface of the drying roller at a downstream location than at an upstream location in the conveyance direction of the recording medium.

* * * * *